US005301438A

United States Patent [19]

Tanaka et al.

[11] Patent Number: 5,301,438

[45] Date of Patent: Apr. 12, 1994

[54] DRYING MACHINE

[75] Inventors: Miho Tanaka, Seto; Kinya Hayashi, Toki, both of Japan

[73] Assignee: Kabushiki Kaisha Toshiba, Kawasaki, Japan

[21] Appl. No.: 19,588

[22] Filed: Feb. 19, 1993

[30] Foreign Application Priority Data

Mar. 27, 1992 [JP] Japan ..... 4-070676

[51] Int. Cl.[5] ..... F26B 19/00

[52] U.S. Cl. ..... 34/48; 34/50

[58] Field of Search ..... 34/48, 52, 53, 55, 46, 34/50, 54

[56] References Cited

U.S. PATENT DOCUMENTS 4,267,643 5/1981 Haried ..... 34/55 X
4,531,305 7/1985 Nagayasu et al. .
4,713,894 12/1987 Roth et al. .

*Primary Examiner*—Henry A. Bennet
*Attorney, Agent, or Firm*—Cushman, Darby & Cushman

[57] ABSTRACT

A drying machine has a degree-of-dryness detecting circuit which detects the degree of dryness of clothes in a drying chamber and a temperature detecting circuit which detects the temperature of the air exhausted from the drying chamber. Two heaters are turned on until the degree of dryness reaches 65%. After that, the temperature is controlled in a range of 40° to 53° C. until the degree of dryness reaches 90%. After that, one heater is actuated intermittently so that the temperature of the air which is drawn into the drying chamber decreases.

19 Claims, 5 Drawing Sheets

DRYING MACHINE

BACKGROUND OF THE INVENTION

The present invention relates to a drying machine for drying clothes or the like contained in a drying chamber.

A prior drying machine is disclosed in U.S. Pat. No. 4,738,034. In the disclosed drying machine, the drying machine comprises a heater for heating the air and a fan for supplying the heated air to a drying chamber within a drum. Since the water included in washed clothes is evaporated, and the humidified air is exhausted from the drying chamber, the clothes in the drying chamber are dried. The drying machine has a detector of degree of dryness of clothes in the drying chamber, also. When the drying operation of clothes progresses and the degree of dryness has reached a predetermined value, for example, 95%, the heater and the fan are deenergized, that is, the drying operation is completed.

General speaking, there are three stages in the drying operation, comprising an initial stage I, a middle stage II and a final stage III, as shown in FIG. 7. FIG. 7 shows the relation of the temperature of the air exhausted from the drying chamber and the time.

In the initial stage I, the air heated by the heater is supplied to the clothes, the temperature of clothes rises gradually, and the temperature of the air exhausted from the drying chamber rises gradually, also.

In the middle stage II after the initial stage I, the heat supplied to the clothes, that is, the heat supplied from the heater is equivalent to the heat needed for drying the clothes, so that the temperature of the air exhausted from the drying chamber is constant.

In the final stage III after the middle stage II, the heat supplied to the clothes is more than the heat needed for drying the clothes. Because the evaporation of the water included in clothes is substantially completed, and the heat absorbing water included in the clothes is minimal, the temperature of the air exhausted from the drying chamber increases rapidly.

In the prior arrangement, the heater and the fan work continually from the beginning of the drying operation to the end of the drying operation. The temperature of the air in the drying chamber becomes too high especially in the final stage III of the drying operation. As a result, in the case that clothes are made of a synthetic fiber, for example, acrylic fiber or polyester fiber, since the melting point of the synthetic fiber is relatively low, there is a problem that clothes shrink or the appearance of clothes are damaged, for instance, a feeling of touching clothes is tough, a luster of clothes is lost, a nap of the clothes is raised, and pilling may occur.

On the other hand, in the case that the clothes are made of a natural fiber, for example, cotton fiber, which includes water inside of the fiber as a characteristic of the natural fiber, there is a period II+, when the speed of the dryness of clothes is reduced, in the latter portion of the middle stage II. In the period II+, the water on the surface of the natural fiber has already been evaporated, the water held inside of the natural fiber comes to the surface thereof, and the water which come to the surface is evaporated. However, the speed of the water coming to the surface of the natural fiber is slower than the speed of the evaporation of the water coming to the surface, so the surface of the clothes becomes too dry. As the heated air is supplied to clothes continuously during the drying operation, the amount of heat supplied to the clothes is excessive. Therefore, the speed of the evaporation and the speed of water coming out from the inside of the natural fibers are not balanced. As a result, the natural fiber shrinks and the appearance of the clothes made with the natural fiber is damaged.

SUMMARY OF THE INVENTION

It is an object of the present invention to provide a drying machine which can dry clothes without causing the shrinkage of clothes and the damage of the appearance of clothes, such as can occur in a conventional dryer, regardless of the type of clothes being dried.

It is another object of the present invention to provide a drying machine which can dry clothes without causing the shrinkage of clothes and the damage of the appearance of clothes, even if clothes made of the synthetic fiber and the natural fiber are dried in the drying machine at the same time, such as a drying machine used in a home.

In order to achieve the above objects of the present invention, there is provided a drying machine comprising:

a) a drum constituting a drying chamber, for containing clothes to be dried;

b) heating means for heating air supplied to the chamber;

c) means for determining a degree of dryness of the clothes in the drying chamber;

d) means for detecting the temperature of the heated air; and e) control means, responsive to the dryness determining means and the temperature detecting means, for controlling the amount of heat supplied by the heating means to maintain the heated air temperature in a predetermined temperature range when the clothes dryness reaches a first dryness value, and for controlling the heating means to supply heat intermittently when the clothes dryness reaches a second dryness value.

In a drying machine for drying clothes, including a drum constituting a drying chamber for containing the clothes, heating means for heating air supplied to the chamber, means for determining a degree of dryness of the clothes in the drying chamber and means for detecting the temperature of the heated air, a method for controlling the heating means, comprising the steps of:

actuating the heating means to maintain the heated air temperature in a predetermined temperature range when the clothes dryness reaches a first value; and operating the heating means at a reduced power level when the clothes dryness reaches a second dryness value.

BRIEF DESCRIPTION OF THE DRAWINGS

In the accompanying drawings:

FIGS. 1 through 6 show an embodiment of the present invention, in which:

FIG. 1 is a block diagram showing an electrical arrangement of the drying machine including an embodiment of the present invention;

FIG. 2 is a view in vertical section of the entire drying machine;

FIGS. 3 and 4 illustrate a flow chart showing a drying operation;

FIG. 5 is a graph showing the relationship between the temperature of the air exhausted from the drying chamber and a time for a drying operation, in the case of clothes made of a natural fiber;

FIG. 6 is a graph similar to FIG. 5, in the case of clothes made of a synthetic fiber.

DESCRIPTION OF THE PREFERRED EMBODIMENT

Figure 1:
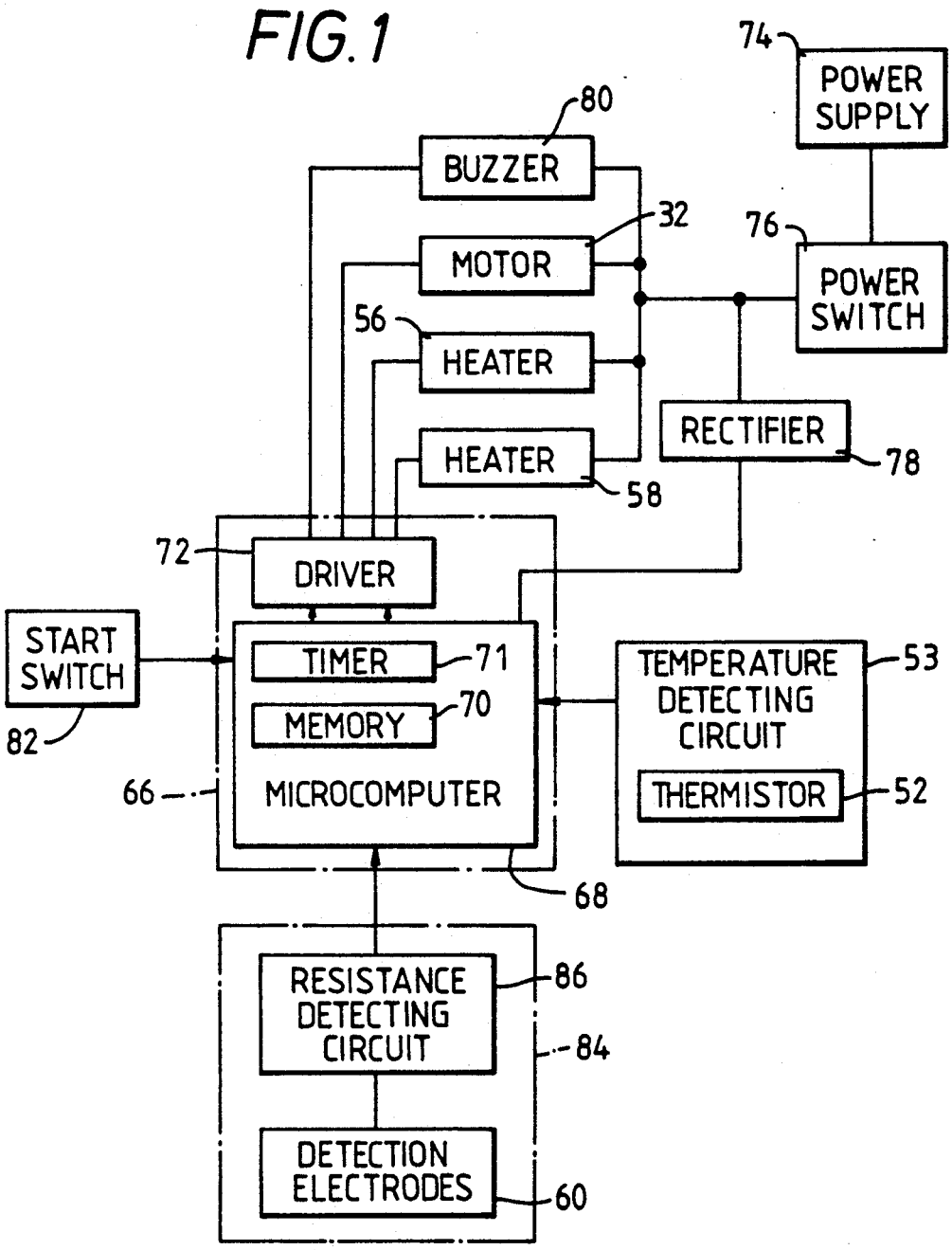
Figure 2:
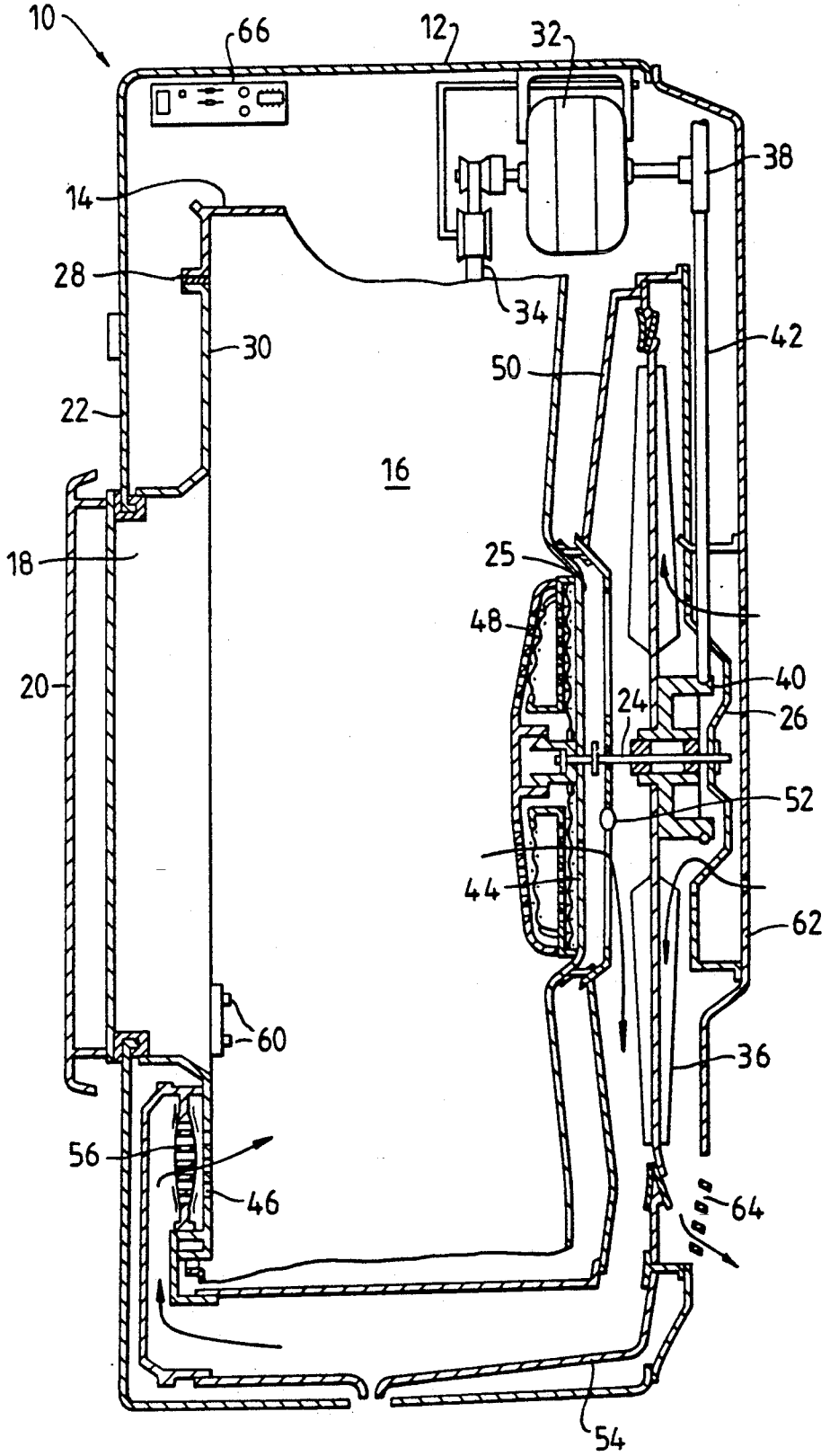

In FIG. 2, a drying machine 10 has an outer casing 12 and a drum 14 constituting a drying chamber 16 which is located in the outer casing 12. An opening 18 through which clothes are put into and taken out of the drying chamber 16 is formed in the middle front of the outer casing 12. A door 20 which opens and closes the opening 18 is pivotally mounted on a front face 22 of the outer casing 12. The drum 14, having an axial shaft 24 provided on the axial center of the rear side 25 thereof, is rotatably supported by a rear plate 26 located near a rear portion of the outer casing 12. A large opening 28, connected to the opening 18, formed on the front side of the drum 14 is rotatably supported by an annular support plate 30 fixed on the front face 22. Within an upper portion of the outer casing 12, a motor 32 which rotates the drum 14 through a belt 34, is located outside of the drum 14. A rotating heat exchanger 36 of a double fin type as fan means is provided between the rear side 25 of the drum 14 and the rear plate 26, and is rotatably supported by the axis 24. The heat exchanger 36 is driven by the motor 32 through a pair of pulleys 38 and 40 and a fan belt 42. A plurality of outlets 44 are formed on the rear side 25 of the drum 14, and several inlets 46 are formed on the lower side within the annular support plate 30. A filter 48 is located on the rear side 25 within the drum 14, which covers the outlets 44. A fan casing 50 is located on a rear portion of the rear side 25 of the drum 14. A thermistor 52 which is one part of a temperature detecting circuit 53 (FIG. 1), is provided near the outlets 44 on the fan casing 50. A duct 54 is provided on the outside of the drum 14, which connects the outlets 44 and the inlets 46. Electrical heating elements 56 and 58 are located near the inlets 46 in the duct 54, which are arranged in a row. A pair of detection electrodes 60 are fixed to the support plate 30. The detection electrodes 60 face the inside of the drum 14 to make contact with clothes put into the drum 14. Drawing holes 62 and drain holes 64 are formed in the rear portion of the outer casing 12, so that outside air flow from the drawing holes 62 proceeds through the heat exchanger 36 to the drain holes 64 due to the rotation of the heat exchanger 36.

With reference to FIG. 1, a controller 66 of drying machine 10 includes a microcomputer 68 having a memory 70 in which programs are stored, a timer 71 and a driver 72. AC power supply 74 is coupled to the microcomputer 68 through a power switch 76 and a rectifier 78. The AC power supply 74 is coupled in parallel to a buzzer 80, the motor 32 and the heating elements 56 and 58 through the power switch 76. The microcomputer 68 is coupled to the buzzer 80, the motor 32 and the heating elements 56 and 58 through the driver 72, so that the buzzer 80, the motor 32 and the heating elements 56 and 58 are turned on and off based on the output signal from the microcomputer 68. The temperature detecting circuit 53 is coupled to the microcomputer 68, so that the microcomputer 68 receives an indication of the temperature of the inside air exhausted through the outlets 44 in accordance with the resistance of the thermistor 52. A start switch 82 is coupled to the microcomputer 68. When the start switch 82 is depressed, the program in the memory 70 is started, provided that the power switch 76 is turned on. A degree-of-dryness detecting circuit 84 as a degree-of-dryness detecting means comprises the detection electrodes 60 and a resistance detecting circuit 86. The resistance detecting circuit 86 detects the resistance of clothes contacting the detection electrodes 60. The degree-of-dryness detection circuit 84 detects the degree of dryness in accordance with the detected resistance, and the data of the degree of dryness is output to the microcomputer 68.

Moreover, the degree-of-dryness detecting circuit 84 is disclosed in U.S. Pat. No. 4,738,034, in detail, the contents of which are incorporated herein by reference. A degree of dryness is defined as follows.

W1: weight of clothes in the state that clothes are held for one day in a room: Temperature is 20° C., Humidity is 65%

W2: actual weight of clothes

X: degree of dryness (%)

$$X = \frac{W1}{W2} \times 100$$

A relationship of the resistance of clothes contacting the detection electrodes 60 and the degree of dryness is obtained through experiment. Therefore, the degree of dryness can be obtained from the resistance of clothes.

Figure 3:
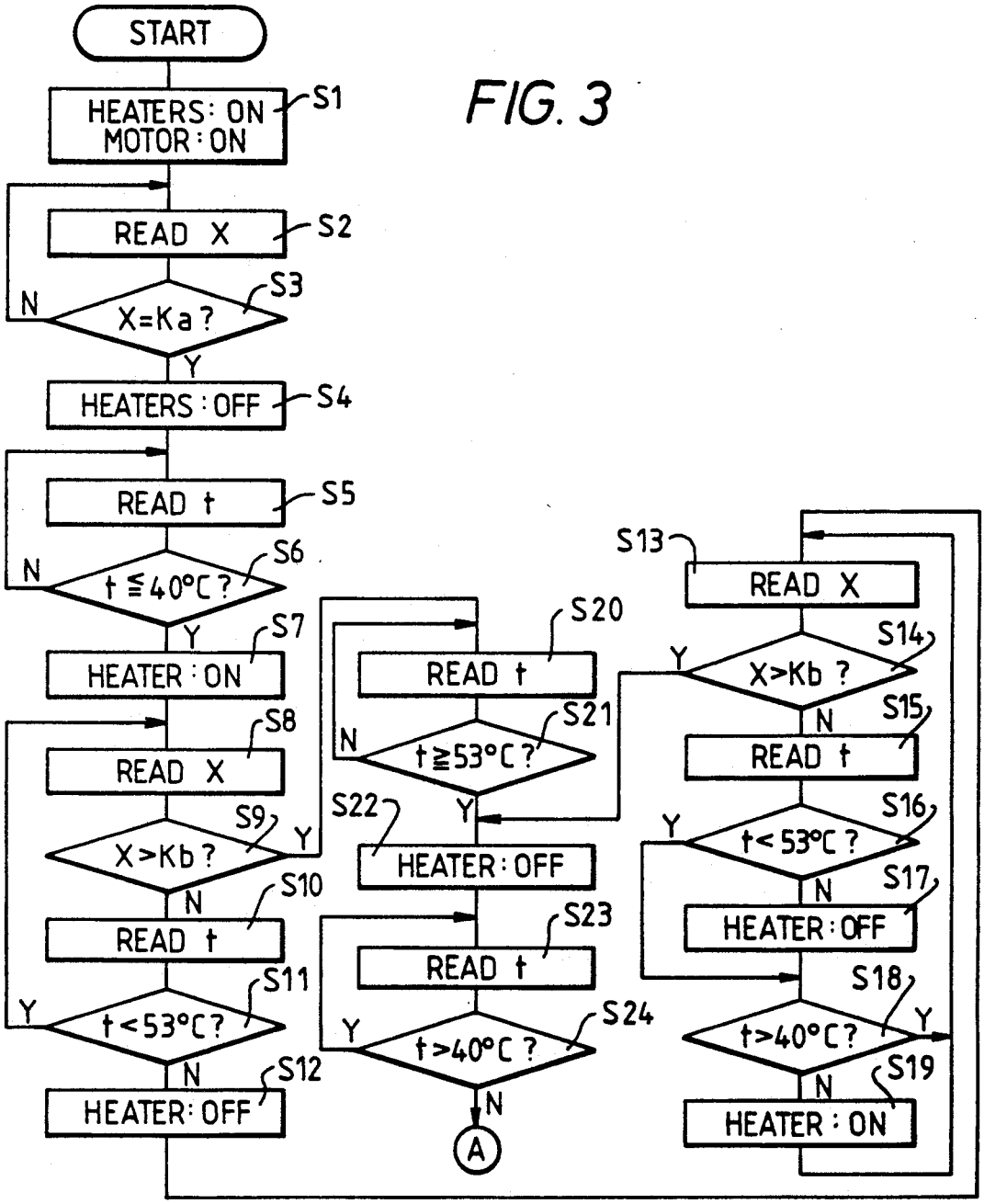
Figure 4:
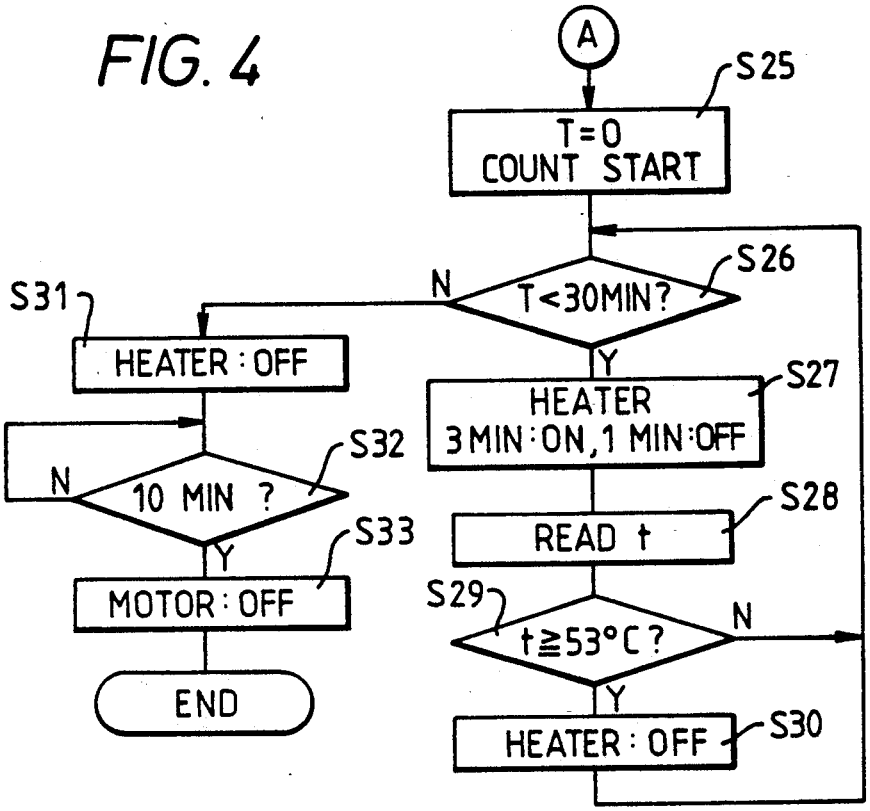
Figure 7:
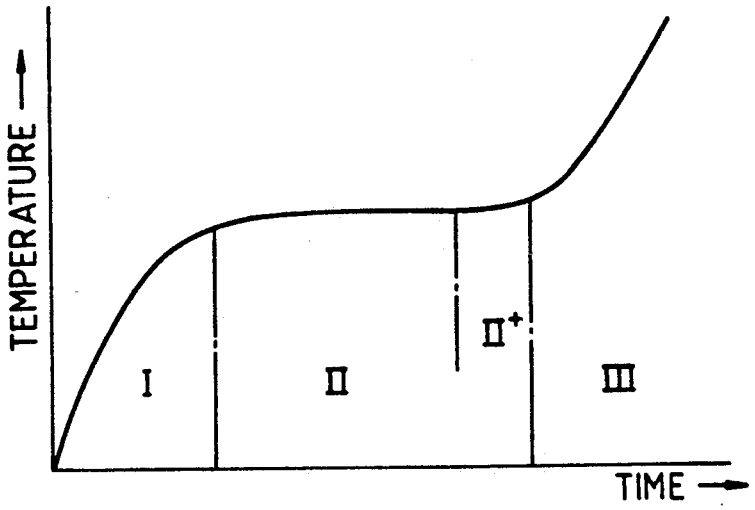
FIG. 7 is a graph showing the relationship between the temperature of the air exhausted from the drying chamber and a time for a conventional drying operation, and showing three stages during the conventional drying operation.

With reference to FIG. 3 and FIG. 4, an operation of the drying machine 10 based on the program in the microcomputer 68 will be described as follows.

The door 20 is opened, clothes are put into the drying chamber 16, then the door 20 is closed. When the power switch 76 is turned on, and the start switch 82 is depressed, an alternating current is supplied to the heating elements 56 and 58 and the motor 32 by the signal from the microcomputer 68 through the driver 72 (step S1). As a result, the heating elements 56 and 58 generate heat and the drum 14 and the heat exchanger 36 rotate respectively. Air in the duct 54 is heated by the heating elements 56 and 58, and the heated air is drawn into the drying chamber 16 through the inlets 46. Clothes in the drying chamber 16 are dried. The moist air is exhausted to the duct 54 through the filter 48 and the outlet 44 due to the rotation of the heat exchanger 36. The exhausted air is cooled by outside air, which is drawn through the drawing holes 62 and is discharged through the drain holes 64, through the heat exchanger 36. As a result, the temperature of the exhausted air reduces. The cooled air is flowed to the heating elements 56 and 58 through the duct 54, and is reheated by the heating elements 56 and 58. The circulation is continued. The resistance detecting circuit 86 detects the resistance of clothes contacting the detection electrodes 60 upon the rotation of the drum 14. The degree-of-dryness detecting circuit 84 detects the degree of dryness X of clothes in accordance with the value of resistance. The degree of dryness X is input to the microcomputer 68 frequently, the microcomputer 68 reads the data X (step S2). The degree of dryness X increases gradually with time, the microcomputer 68 judges if the degree of dryness X is equal to a predetermined first degree of dryness Ka (step S3). The first degree of dryness Ka is set to 65% being a selected value in a preferred range of 60 to 70%. When the degree of dryness X of actual data is equal to the first degree of dryness Ka, the heating elements 56 and 58 are turned off (step S4). After that, the temperature detecting circuit 53 frequently detects the temperature t° C. of the exhausted air through the outlets 44. The data of the temperature t° C. is input to the microcomputer 68 (step S5). Although the temperature t° C. is high at the time when the heating elements 56 and 58 are turned off, since the heating elements 56 and 58 are being turned off, the temperature t° C. decreases gradually with time. After the temperature t° C. of actual data is equal to a predetermined lower temperature, for example, 40° C. (step S6), the heating element 56 is turned on and off by the microcomputer 68 so that the temperature t° C. is in a range between 40° C. and a predetermined upper temperature, for example, 53° C. Thus, the predetermined lower and upper temperature define a predetermined temperature range. After the step S6, the heating element 56 is turned on (step S7), the microcomputer 68 reads the degree of dryness X input from the degree-of-dryness detecting circuit 84 (step S8). The microcomputer 68 judges if the degree of dryness X reaches a predetermined second degree of dryness Kb (step S9). The second degree of dryness Kb is set to 90% being a selected value in a preferred range of 85 to 95%.

When the degree of dryness X does not reach the second degree of dryness Kb, that is 'NO' in the step S9, the microcomputer 68 reads the temperature t° C. input from the temperature detecting circuit 53 (step S10), the microcomputer 68 judges if the temperature t° C. is less than 53° C. (step S11). In the step 11, when the temperature t° C. is not less than 53° C., the heating element 56 is turned off (step 12). Following step 12, the microcomputer 68 reads the degree of dryness X (step S13), and the microcomputer 68 judges if the degree of dryness X reaches the second degree of dryness Kb (step S14). When the degree of dryness X does not reach the second degree of dryness Kb, the microcomputer 68 reads the temperature t° C. again (step 15). The temperature t° C. read in the step S15 is judged to determine if it is less than the upper temperature 53° C. (step S16). When the temperature t° C. is not less than 53° C. in the step S16, the heating element 56 is turned off (step S17). When 'YES' is obtained in the step S16, the temperature t° C. is judged to determine if the temperature t° C. is more than 40° C. (step S18). When the temperature t° C. is not more than 40° C,. that is 'NO' in the step S18, the heating element 56 is turned on (step S19). When 'YES' is obtain in the step S18, the process returns to the step S13.

In the step S14, when the degree of dryness X is greater than the second degree of dryness Kb, the heating element 56 is turned off (step S22).

In the step S9, when the degree of dryness X is greater than the second degree of dryness Kb, the microcomputer 68 reads the temperature t° C. (step S20). When the temperature t° C. read in the step S20 is greater than the upper temperature 53° C., the heating element 56 is turned off (step S22).

The reason why the step S8 to the step S11 and the step S20 and the step S21 are provided is as follows. The degree-of-dryness detecting circuit 84 may have a defect by which even though the degree of dryness X does not increase sufficiently, the microcomputer 68 does not recognize that the degree of dryness X reaches the second degree of dryness Kb, thereby the drying operation is completed without efficient drying. To prevent the above problem, the heating element 56 is turned on, and the air which is drawn into the drying chamber 16, is reheated until the temperature t° C. becomes the upper temperature 53° C.

After the heating element 56 is turned off in the step S22, the microcomputer 68 reads the temperature t° C. from the temperature detecting circuit 53 (step S23). When the temperature t° C. is not more than 40° C., the time is set to zero and the timer 71 starts to count the time (step S24 and S25). The microcomputer 68 judges if the time T of the timer 71 is less than 30 minutes (step S26), in the case of 'YES' in the step S26, the heating element 56 is actuated intermittently, such as a pattern of 3 minutes on and 1 minute off (step S27). While the heating element 56 is actuated in the pattern, the microcomputer 68 reads the temperature t° C. When the temperature t° C. is not less than the upper temperature 53° C. (judged in step S29), the heating element 56 is turned off (step S30).

When the time of the timer 71 is not less than 30 minutes in the step S26, the heating element 56 is turned off (step S31), the motor 32 is also turned off 10 minutes after that. As a result, the drying operation is completed.

Figure 5:
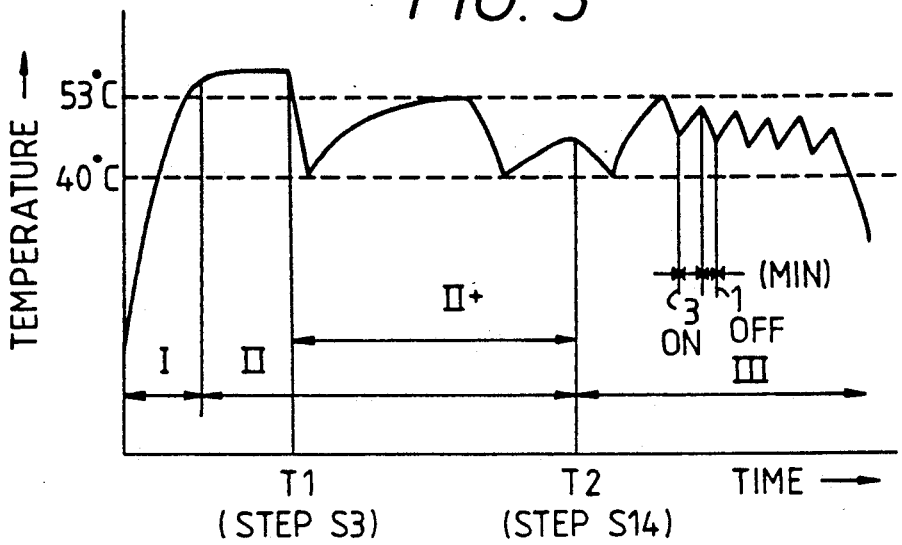

FIG. 5 shows the relationship between the temperature of the exhausted air through the outlets 44 and the elapsed time of the drying operation in the case of clothes being of natural fiber such as a cotton fiber.

Figure 6:
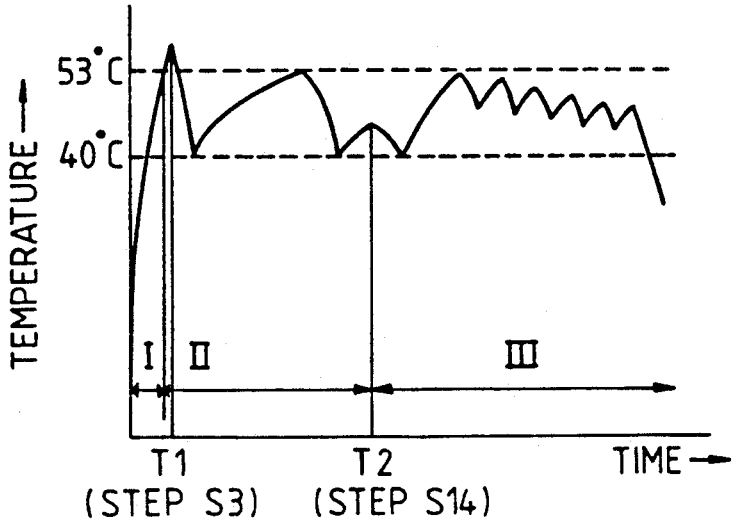

FIG. 6 shows the relationship between the temperature of the exhausted air through the outlets 44 and the elapsed time of the drying operation in the case of clothes being synthetic fiber.

With reference to FIG. 5 and FIG.6, the air of high temperature which is heated by the heating element 56 and 58, is drawn into the drying chamber 16 from the beginning of the drying operation to the time T1 when the degree of dryness X reaches the first degree of dryness. During the above time which corresponds to the initial stage I and the middle stage II of the conventional drying operation, clothes in the drying chamber 16 are dried efficiently by the high temperature air since the temperature is not controlled. The water positioned on a surface of the natural fibers is evaporated. When the degree of dryness X reaches the first degree of dryness Ka, for example, 60 to 70%, in the case of clothes being of natural fiber, the water included inside of the fiber moves to the surface of the fiber since the water or the fiber surfaces has already been evaporated. The moved water is gradually evaporated. During the time the temperature is controlled in a range of 40° to 53° C., the temperature of the air drawn into the drying chamber 16 reduces. Therefore, since the moved water on the surface of the fiber is not evaporated rapidly, the speed of evaporation of the water on the surface of the fiber is balanced with the speed of water moving from the inside of the fiber to the surface of the fiber. As a result, in the case of clothes being of natural fiber, shrinkage of such clothes is minimized and a damage of the appearance of such clothes is also minimized.

In the case of clothes being of synthetic fiber, since synthetic fiber does not include the water inside of the fiber, the degree of dryness is between the first degree of dryness, for example 60%, and the second degree of dryness, for example 95%. The synthetic fiber clothes shrink little. Because the water does not move out from the inside of the fibers, the speed of the drying of clothes is fast. It takes no longer time to the first degree of dryness compared to clothes being of natural fiber.

When the degree of dryness reaches the second degree of dryness, for example 90%, most of the water has been already evaporated and the temperature increases rapidly. In the case of clothes being of synthetic fiber, since the melting point of the synthetic fiber is relatively low, it is easy for synthetic fiber to shrink and to damage the appearance of such clothes. According to the embodiment, when the degree of dryness reaches the second degree of dryness the heating element 56 actuates intermittently. Thus, the temperature of the air decreases. Therefore, in the last period of the drying operation of the illustrated embodiment, since the temperature of the air does not become too high, the shrinkage of clothes is minimized and the damage of the appearance of clothes is minimized even if clothes are of synthetic fiber.

In the embodiment, in which the second degree of dryness is set to about 85 to 95%, it is especially useful for the synthetic fiber to minimize the shrink and damage of the appearance of clothes.

A table described as follows shows the relationship of the drying operation time and a rate of shrinkage of natural fiber and synthetic fiber. The table compares the present invention, a prior drying machine and natural drying. The natural drying is defined as clothes provided horizontally on a net and dried in a room.

| | | PRESENT INVENTION | PRIOR DRYING MACHINE | NATURAL DRYING |
|---|---|---|---|---|
| NATURAL FIBER | DRYING OPERATION TIME | 2 hours | 1.3 hours | 8 hours |
| | A RATE OF SHRINK | 6.0% | 11.5% | 1.5% |
| SYNTHETIC FIBER | DRYING OPERATION TIME | 1.5 hours | 0.7 hours | 3 hours |
| | A RATE OF SHRINK | 3.5% | 6.5% | 2.0% |

As shown in the table, in the present invention, the rate of shrinkage of both of natural fiber and synthetic fiber is lower compared with the prior drying machine. As compared with natural drying, the natural drying takes much longer to dry clothes, though the rate of shrink is low.

According to the embodiment, the rate of shrinkage can be minimized without taking much time to dry clothes.

Moreover, the present invention is especially more effective in the case of both natural fiber and synthetic fiber clothes being dried at the same time.

The-foregoing disclosure and drawings are merely illustrative of the principle of the present invention and not to be interpreted in a limiting sense. The only limitation is to be determined from the scope of the appended claims.

Although an embodiment has been disclosed in which a drying machine utilizes electric heating, the invention can be successfully practiced in a drying machine which utilizes gas combustion to generate heat for drying. Further, although in the disclosed embodiment a temperature of exhausted air is used to control the drying operation, a temperature of air within the drum could also be used to effect such control.

What is claimed is:

1. A drying machine comprising:

a) a drum constituting a drying chamber for containing clothes to be dried;

b) heating means or heating air supplied to the chamber;

c) means for determining a degree of dryness of the clothes in the drying chamber;

d) means for detecting the temperature of the heated air; and e) control means for controlling the amount of heat supplied by the heating means, said control means being responsive to the dryness determining means and the temperature detecting means in order to maintain the heated air temperature within a predetermined temperature range when the clothes dryness reaches a first dryness value, and for controlling the heating means to supply heat intermittently when the clothes dryness reaches a second dryness value.

2. A drying machine, comprising:

a) a drum constituting a drying chamber, for containing clothes to be dried;

b) heating means for heating air supplied to the chamber;

c) means for determining a degree of dryness of the clothes in the drying chamber;

d) means for detecting the temperature of the heated air; and e) control means, responsive to the dryness determining means and the temperature detecting means, for actuating the heating means in order to maintain the heated air temperature in a predetermined temperature range when the clothes dryness reaches a first value, and for operating the heating means at a reduced power level when the clothes dryness reaches a second dryness value.

3. A drying machine according to claim 1, wherein the first dryness value is in a range of approximately 60 to 70% dry.

4. A drying machine according to claim 1, wherein the second dryness value is in a range of approximately 85 to 95%.

5. A drying machine according to claim 1, wherein the first dryness value is in a range of approximately 60 to 705, and the second dryness value is in a range of approximately 85 to 95% dry.

6. A drying machine according to claim 1, wherein after the degree of dryness reaches the second dryness value and the control means controls the heating means to supply heat intermittently, the temperature of the air supplied to the drying chamber gradually becomes lower.

7. A drying machine according to claim 1, wherein the heating means comprises at least two electrical heating elements; and the control means comprises means for turning off at least one of the two heating elements after the first dryness value is reached.

8. A drying machine according to claim 1, wherein the heating means generates heat by gas combustion.

9. A drying machine according to claim 1, further comprising fan means for supplying the air heated by the heating means to the drying chamber.

10. A drying machine according to claim 9, wherein the fan means includes a heat exchanger for cooling the heated air after exhaustion from the drying chamber, the temperature detecting means being located between the outside of the drum and the heat exchanger.

11. A drying machine according to claim 1, wherein the drying determining means includes two electrodes and resistance means for detecting a resistance of clothes across the detection electrodes upon rotation of the drum.

12. A drying machine according to claim 1, wherein the predetermined temperature range is from 40 to 53° C.

13. A drying machine, comprising:

a) a rotary drum having an outlet and an inlet, constituting a drying chamber, for containing clothes to be dried;

b) an air duct connecting the inlet and the outlet;

c) fan means, provided at a rear portion of the drum, for circulating air exhausted from the outlet to the inlet through the duct, and for exchanging heat between the exhausted air and outside air;

d) heating means, located in the duct, for heating the air being supplied to the chamber through the inlet;

e) two detection electrodes mounted for contacting clothes in the drum;

f) detection means for detecting a degree of clothes dryness in accordance with a resistance of clothes in contact with the detection electrodes;

g) means, located near the outlet, for detecting the temperature of the air exhausted from the outlet; and h) control means, responsive to the degree of dryness of clothes and the exhausted air temperature, for controlling the heating means in order to maintain the exhausted air temperature within a predetermined range after the degree of dryness reaches a first value, and for controlling the heating means to operate intermittently so that the temperature of the air supplied to the drying chamber gradually becomes lower after the degree of dryness reaches a second value.

14. In a drying machine for drying clothes, comprising a drum constituting a drying chamber for containing the clothes, heating means for heating air supplied to the chamber, means for determining a degree of dryness of the clothes in the drying chamber and means for detecting the temperature of the heated air, a method for controlling the heating means, comprising the steps of:

actuating the heating means to maintain the heated air temperature in a predetermined temperature range when the clothes dryness reaches a first value; and operating the heating means at a reduced power level when the clothes dryness reaches a second dryness value.

15. A drying machine according to claim 1, wherein the heated air in the drying chamber does not damage synthetic fabric.

16. A drying machine according to claim 1, wherein the heating means comprises an electric element for generating heat.

17. A drying machine according to claim 10, wherein the temperature detecting means is located between the drum and the heat exchanger.

18. A drying machine according to claim 13, wherein the first value is 60 to 70% dry.

19. A drying machine according to claim 13, wherein the second value is 85 to 95% dry.

* * * * *